US005667082A

United States Patent [19]

Hamilton et al.

[11] Patent Number: 5,667,082

[45] Date of Patent: Sep. 16, 1997

[54] BALL CADDY SYSTEM

[75] Inventors: Robert H. Hamilton, Edina, Minn.; Eric J. Armstrong, Spinnerstown, Pa.

[73] Assignee: Core Group Marketing, Inc., Eden Prairie, Minn.

[21] Appl. No.: 436,019

[22] Filed: May 5, 1995

[51] Int. Cl.[6] ..... A47F 7/00

[52] U.S. Cl. ..... 211/15; 211/59.2; 211/184; 312/49; 206/315.9

[58] Field of Search ..... 211/59.2, 184, 211/15, 14; 312/42, 49, 45; 206/315.9

[56] References Cited

U.S. PATENT DOCUMENTS

| | | | |
|---|---|---|---|
| 849,590 | 4/1907 | Bailey . | |
| 1,418,075 | 5/1922 | Hedenskoog | 211/15 |
| 1,418,093 | 5/1922 | Parmater | 211/15 |
| 2,756,901 | 7/1956 | Cowsert . | |
| 3,018,001 | 1/1962 | Combs . | |
| 3,194,433 | 7/1965 | Heselov . | |
| 3,287,073 | 11/1966 | Holtkamp | 211/59.2 X |
| 3,371,795 | 3/1968 | Rosonke . | |
| 3,427,084 | 2/1969 | Sinclair . | |
| 3,744,866 | 7/1973 | Cook | 312/42 |
| 3,869,137 | 3/1975 | Byrom | 211/14 X |
| 4,002,241 | 1/1977 | Parrilla, Sr. | 211/88 |
| 4,082,209 | 4/1978 | Sanders | 211/15 X |
| 4,344,660 | 8/1982 | Molnar et al. | 312/250 |
| 4,418,930 | 12/1983 | Ryan, Jr. | 280/47.19 |
| 4,561,547 | 12/1985 | Estwanik, III | 211/14 |
| 4,561,550 | 12/1985 | Franklin | 211/184 |
| 4,566,596 | 1/1986 | Hennig | 211/59.2 |
| 4,925,037 | 5/1990 | Holley | 211/59.2 |
| 5,085,327 | 2/1992 | Mercer, Jr. et al. | 211/13 |
| 5,184,735 | 2/1993 | Black | 211/14 |
| 5,314,243 | 5/1994 | McDonald et al. | 312/215 |
| 5,356,033 | 10/1994 | Delaney | 221/194 |

*Primary Examiner*—Robert W. Gibson, Jr.
*Attorney, Agent, or Firm*—Merchant, Gould, Smith, Edell, Welter & Schmidt

[57] ABSTRACT

A ball caddy includes a housing with dividers forming compartments within the housing. The compartments retain various size sports balls in a vertical arrangement The dividers have two hinged segments which are independently adjustably mounted within the housing to vary the size of each of the compartments. Each compartment also has an orifice formed at a lower portion thereof and a ball release device which has a retainer normally preventing dispensing of the balls. The handle attached to the ball release allows pivoting of the ball release to provide for dispensing of the balls through the orifice.

16 Claims, 3 Drawing Sheets

BALL CADDY SYSTEM

BACKGROUND OF THE INVENTION

1. Field of the Invention

The present invention relates to a ball caddy system, and in particular to a ball caddy for storing and displaying various types of balls.

2. Description of the Prior Art

Colleges, schools and sports clubs have a need for storing many balls, and many different types of balls in an orderly manner. Families with children involved in sports also accumulate many types of balls and need to store them in an orderly manner. In addition, sporting goods stores and other retail outlets typically sell several types of balls used for various sports. Balls have various sizes and configurations such as footballs, soccer balls, basketballs, volleyballs, as well as smaller balls such as softballs, tennis balls and baseballs. Typically the balls are sold in a package or box, while the smaller balls may also be sold in tubes or other multiple packs. The packaging required for displaying the balls and for making them stackable greatly adds to their cost. In addition, the packaging requires additional space and shelving which might otherwise be utilized for displaying other articles.

Although devices are known which are able to retain a large number of balls, the devices generally have a cage-like construction which is not aesthetically pleasing. Furthermore, the devices are generally configured for retaining only one type of ball or for retaining the balls in a mixed assortment, rather than separating the balls by size or use. The devices also do not provide for vending a single ball of the type selected by a purchaser or user from the device.

It can be seen then that an improved ball storage and vending apparatus is needed which is capable of retaining balls of different types which can be separated in an aesthetically pleasing setting. Furthermore, such a device should allow for releasing the ball of the user's choice from the device at any time. The storage device should also provide an aesthetically pleasing environment for the balls. The utility of such a device is also increased by providing flexibility for retaining different types of balls as the storage requirements for the device change. Such a storage and display apparatus should be either mobile or mountable to a vertical surface to adapt to different storage needs. The present invention addresses these as well as other problems associated with display and storage of sports balls.

SUMMARY OF THE INVENTION

The present invention is directed to a ball caddy, and in particular to a ball caddy which is utilized for storing, displaying and dispensing various size sports balls. The ball caddy includes a housing which is substantially transparent so that potential buyers can easily view the balls which are being stored. The housing is divided into a number of compartments which store sports balls such as footballs, soccer balls, basketballs, volleyballs and the like in a vertical column arrangement. Ends of the caddy have substantially smaller compartments which are used for storing smaller sports balls such as softballs, baseballs and tennis balls.

The ball caddy includes wheels and a handle for providing mobility to the caddy. The caddy may also be set directly on the floor. In addition, wall mounting brackets may be added for mounting the caddy against a vertical surface.

In a preferred embodiment, the dividers extend vertically within the housing to separate the compartments. The dividers are formed of two segments hingedly connected along one edge. The hinged edge mounts against one wall of the housing while the free edge engages slots formed in the opposite wall. The slots are formed in an arcing configuration centered along the mounting point of the hinged end of the segments. In this manner, the free ends of the divider may be moved in any of the various slots to increase or decrease the size of the compartments. In addition, the free ends may be positioned in the same slot or may be separated to further decrease or increase the size of the compartments.

The housing also includes orifices formed in one of the walls for each compartment and a ball release corresponding to each orifice in each compartment. The ball release includes a retaining portion and a handle which may be also operated as a foot pedal. The ball release includes a ball support which utilizes the weight of the stored balls for pivoting the ball release to its normal position wherein the balls are retained in the compartment. When the handle or foot pedal is actuated by moving it downward, the retaining portion is moved to a substantially horizontal position wherein the balls may be dispensed through the orifice.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals designate corresponding elements throughout the several views.

DETAILED DESCRIPTION OF THE PREFERRED EMBODIMENT(S)

Figure 1:
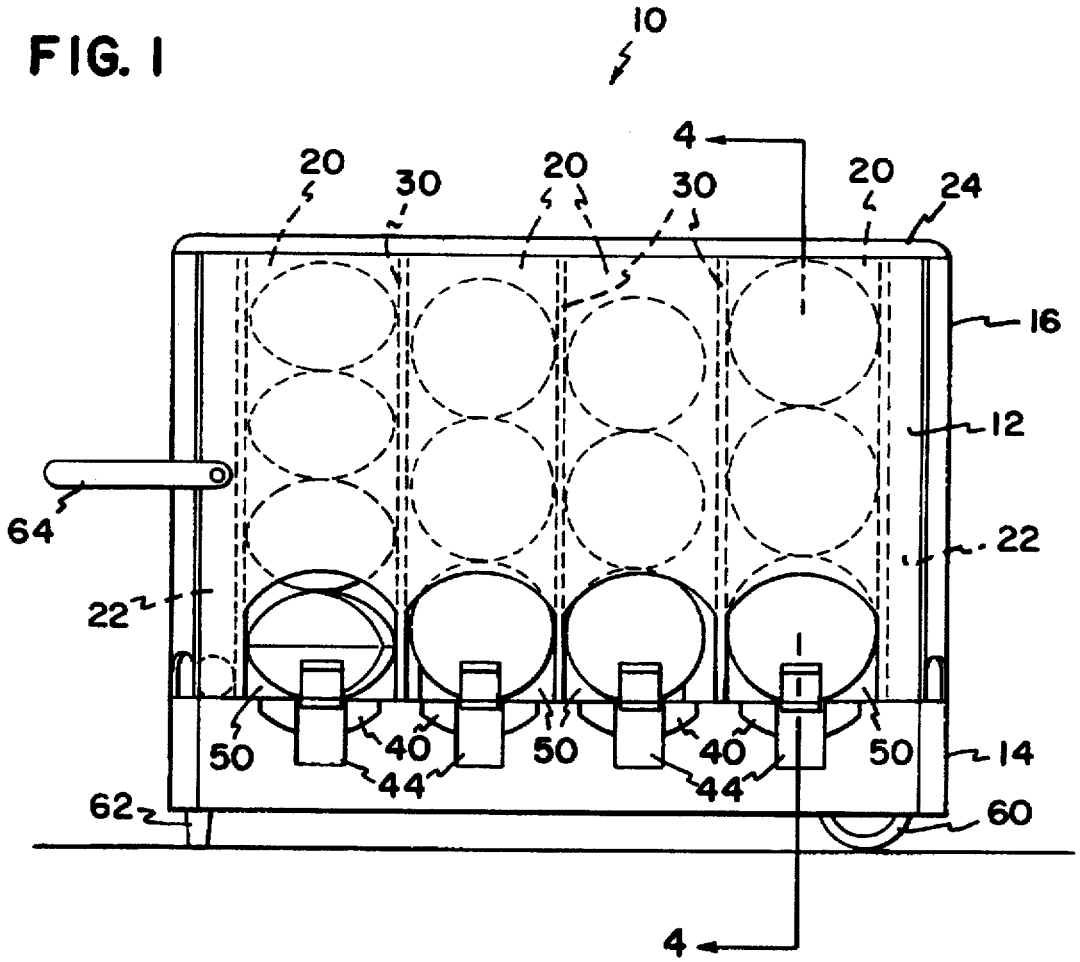
FIG. 1 shows a front elevational view of a ball storage apparatus according to the principles of the present invention.
Figure 2:
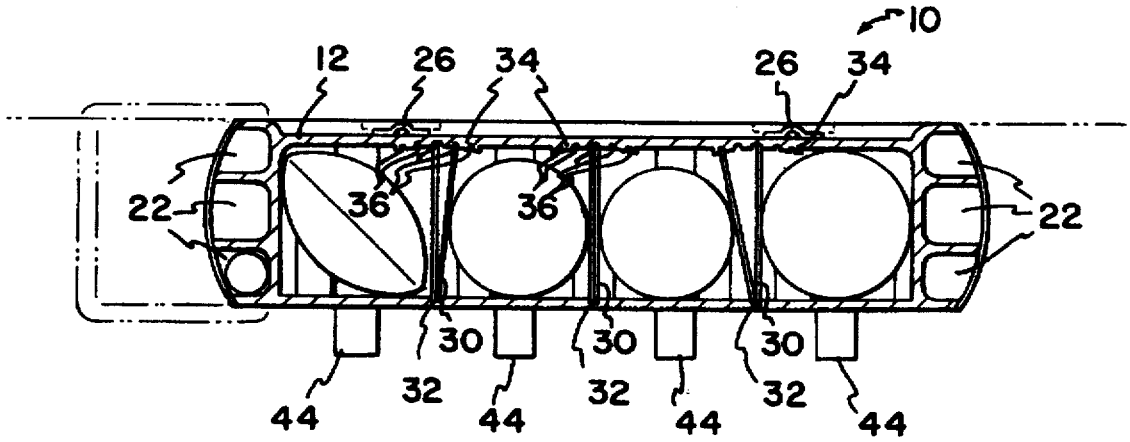
FIG. 2 shows a top sectional view of the ball storage apparatus/taken of FIG. 1 with the top removed and configured for wall mounting.

Referring now to the drawings, wherein like reference numerals designate corresponding structure throughout the views, and referring in particular to FIG. 1, there is shown a ball caddy apparatus, generally designated 10. The caddy 10 includes a housing 12 which include a lower base portion 14 and upper portion 16 which typically will be transparent for displaying stored balls, and a removable top cover 24. In the preferred embodiment, the housing 12 is made of any one of various plastic materials which are well known to provide a rugged, yet lightweight construction. In the preferred embodiment, the storage and display caddy 10 is mounted on wheels 60 with a support leg 62 at an opposite end. The storage and display caddy 10 also includes a handle 64 above the support leg which provides for pushing or pulling the ball caddy 10 from location to location. It can be appreciated that the wheels 60 and support leg 62 may also be removed for supporting the caddy as a display 10 on the floor. As shown in FIG. 2, the storage and display caddy 10 may also include mounting brackets 26 for mounting the caddy as a display 10 to a wall or other vertical surface.

Figure 4:
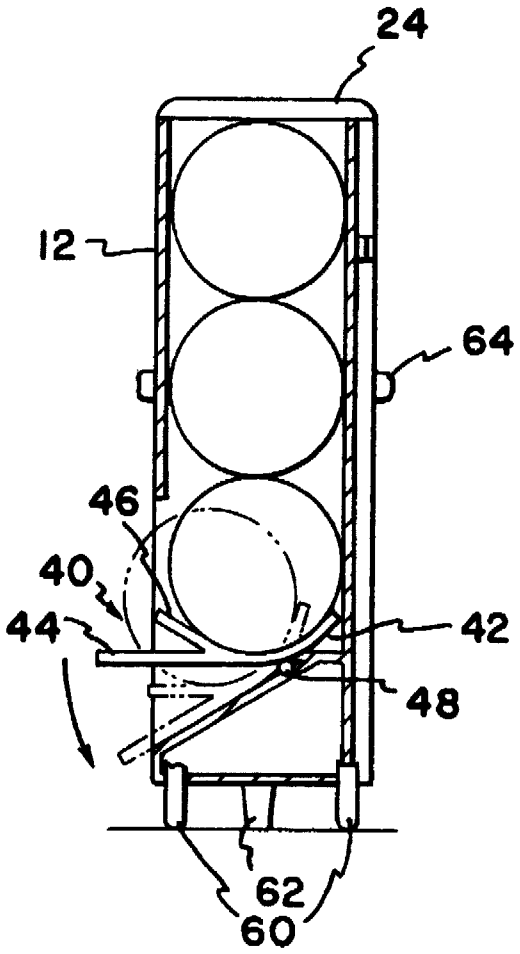
FIG. 4 shows a side sectional view of the ball storage apparatus taken along line 4—4 of FIG. 1.
Figure 3:
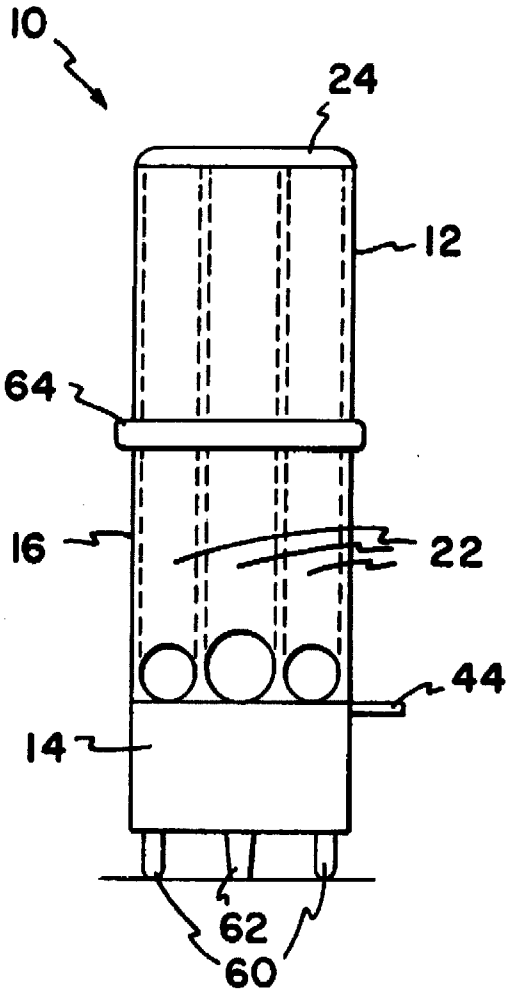
FIG. 3 shows a left side elevational view of the ball storage apparatus shown in FIG. 1.

The housing 12 is divided into a number of compartments 20 by hinged dividers 30, as also shown in FIG. 2. In addition, the number of smaller end compartments 22 are formed at each end of the housing 12, shown most clearly in FIGS. 2 and 3. The compartments 20 and end compartments 22 are both configured in a substantially vertical tube type configuration holding a column of balls of various sizes in a vertical column arrangement. Each of the compartments 20 includes a ball release 40, as shown most clearly in FIGS. 1, 3 and 4. The ball release 40 controls dispensing of the balls in each of the compartments 20 so that one ball may be dispensed at a time. The ball release 40 is positioned before a bottom orifice 50 formed in the front of each compartment 20. When the ball release 40 is actuated, a ball may be removed through the orifice 50.

As shown in FIG. 2 and FIGS. 5–7, the dividers 30 are adjustable to vary the size of each compartment 20. It can be appreciated that with adjustable size for each compartment 20, various sizes can be achieved for efficiently retaining the different size sports balls. For example, as shown in FIG. 2, the four compartments can be configured for retaining respectively, footballs, soccer balls, volleyballs, and basketballs. The compartments 20 are separated by the hinged dividers 30. The dividers 30 include a pair of segments which are hingedly connected along a first edge and insert at the hinged end along the inner portion of the housing 12 at a slot formed in a mounting member 32. Opposite each of the mounting members 32 is an arced divider receiving member 34 having a number of slots 36 formed therein. The arc of the receiving members 34 are centered on the corresponding divider mounting member 32. The slots 36 are configured for receiving the ends of the segments of the dividers 30. It can be appreciated that by independently varying the mounting position of the segments of the various dividers 30 and the slots 36, the size of each of the compartments 20 may be varied to adapt to the different size of the ball being retained.

Figure 5:
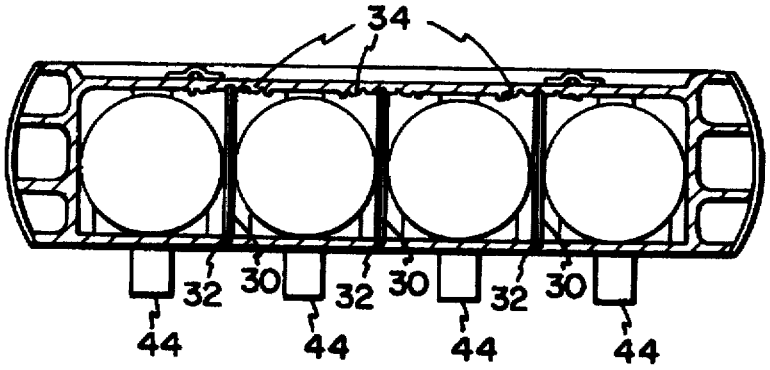
FIG. 5 shows a top view of the ball storage apparatus shown in FIG. 1 with the top removed in an alternate display configuration.
Figure 6:
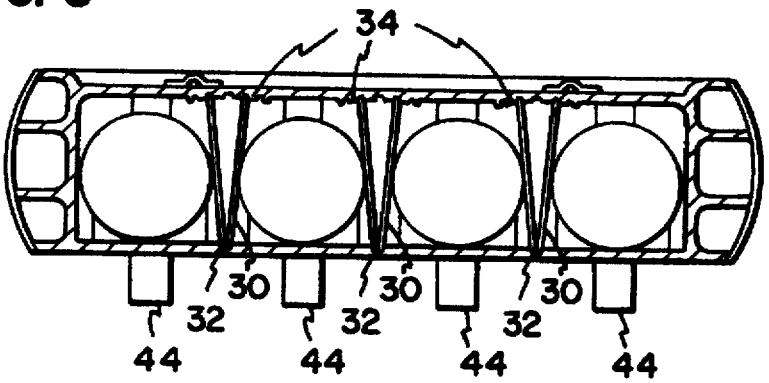
FIG. 6 shows a top view of the ball storage apparatus shown in FIG. 1 with the top removed in a second alternate display configuration; and, FIG. 7 shows a top view of the ball storage apparatus shown in FIG. 1 with the top removed in a third alternate display configuration.
Figure 7:
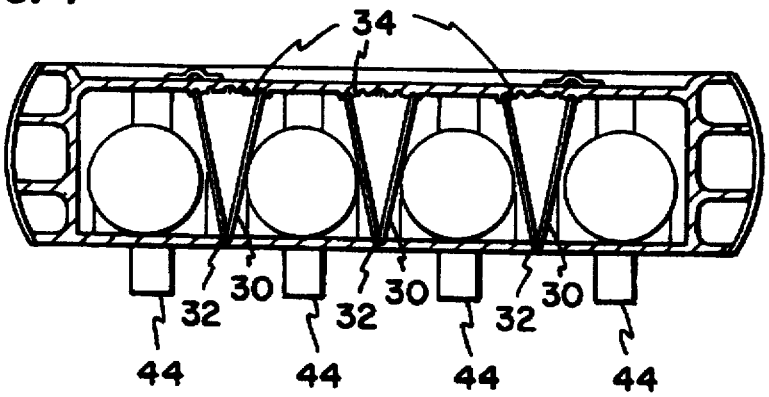

The dividers 30 may have both segments inserted into a single slot 36, or the segments of the divider 30 may be separated, creating a space between the segments and decreasing the size of the compartments 20. The dividers 30 may be easily reconfigured by removing the cover 24 and sliding the dividers upward, then reinserting in the desired position. Referring to FIGS. 5–7, various configurations are shown. For example, the dividers 30 may be mounted with both segments in the same slot for retaining larger balls, as shown in FIG. 6. For slightly smaller balls, the divider segments may be moved outward away from one another to decrease the size of each of the compartments 20. As shown in FIG. 7, for yet smaller balls, the divider segments are spread apart and may be moved to the furthest slots 36 to reduce the size of each of the compartments 20. It can be appreciated that by having adjustable dividers 30 and spaced slots 36 for receiving the dividers, the size of each of the compartments 20 may be varied to fit whatever stock of sports balls is being retained in a column type configuration.

Referring again to FIGS. 1 and 3, the ball releases 40 include a foot pedal 44 which may also be used as a handle for opening the ball release 40. The ball release 40 rotates about a pivot 48 between a raised and lowered position. Above the handle 44 is an angled portion 46 sloping away from the orifice 50 and a ball support portion 42, which forms a cradle for retaining the balls in the normal raised position. In its normal position, the ball release 40 prevents the balls from passing through the orifice 50. However, when the ball release handle 44 is lowered, the retainer portion 46 lowers downward, creating a large enough opening so that the ball may be removed through the orifice 50. Once the ball has been removed, by letting go of the release 40, the weight of stored balls acting on the ball support portion 42 forces the ball release 40 to pivot and moves the retainer portion 46 upward, decreasing the size of the orifice 50 and positioning the angled retainer portion 46 to prevent additional balls from being dispensed through the orifice 50. In an alternate embodiment, the pivot 48 is spring loaded to urge the ball release 40 toward the closed position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A ball storage apparatus, comprising:

an outer housing;

an adjustable divider extending vertically within the housing forming a plurality of storage compartments;

a plurality of tabs forming vertical slots configured for receiving and retaining a free end of the divider;

wherein each of the storage compartments comprises a pivoting bottom ball support.

2. An apparatus according to claim 1, wherein said ball support is biased upward and includes a handle for manually pivoting the ball support down, thereby allowing balls to release from the compartment.

3. An apparatus according to claim 2, wherein each of the compartments has an orifice formed in the housing and aligned proximate the ball support for allowing balls to release through the orifice when the ball support is lowered.

4. An apparatus according to claim 1, wherein the housing comprises a substantially transparent outer housing.

5. An apparatus according to claim 1, further comprising a plurality of end compartments, having a cross sectional area substantially smaller than the storage compartments.

6. An apparatus according to claim 1, further comprising means for mounting the apparatus to a vertical surface.

7. An apparatus according to claim 1, wherein each compartment is configured for retaining a plurality of balls in a single vertical column.

8. An apparatus according to claim 1, further comprising wheels mounted to a lower portion of the housing and a handle mounted to a side of the housing.

9. An apparatus according to claim 2, wherein the bottom support comprises a retainer portion retaining the balls and preventing release in a normal position.

10. An apparatus according to claim 3, wherein the bottom support is normally biased upward and has an angled retainer portion angling away from the orifice in a normal position and extending substantially horizontally in a lowered position.

11. An apparatus according to claim 1, wherein the bottom support is selectively configured for supporting balls, such that the weight of a stored ball pivots the release to a retaining position.

12. A ball storage apparatus, comprising:

an outer housing;

an adjustable divider extending vertically within the housing forming a plurality of storage compartments;

a plurality of tabs forming vertical slots configured for receiving and retaining a free end of the divider;

wherein the divider comprises segments extending between opposed walls of the housing, wherein a first edge of the segments engages a first wall of the housing, and wherein second edges of the segments engage a second wall, wherein the second wall includes a plurality of tabs extending vertically defining a plurality of vertical slots, wherein second edges of the segments are insertable into the slots.

13. An apparatus according to claim 12, wherein each pair of segments are hingedly connected along the first edge.

14. An apparatus according to claim 13, wherein the first edge mounts along the first wall at a position whereat the plurality of tabs define an arc centered on the pivot point.

15. A ball retainer apparatus, comprising:

an outer housing;

a plurality of vertically extending divider segments, wherein each of said segments is mounted along one segment edge to an interior of the housing and dividing the housing into a plurality of compartments;

a receiving member on an interior of the housing associated with each of said segments, the receiving member forming vertical slots configured for receiving and retaining a free end of the associated segment.

16. A storage apparatus, comprising:

a housing;

a plurality of vertically extending dividers having a pair of segments hinged along a first edge, wherein each of said segments is mounted along one vertical segment edge to an interior of the housing and dividing the housing into a plurality of compartments;

a plurality of vertically extending flanges mounted on an interior of the housing associated with each pair of segments forming vertical slots configured for receiving and retaining free ends of the associated segments.

* * * * *